US006824672B2

(12) United States Patent
Lecour et al.

(10) Patent No.: US 6,824,672 B2
(45) Date of Patent: Nov. 30, 2004

(54) USE OF AUSTENITIC STAINLESS STEELS IN APPLICATIONS REQUIRING ANTI-COKING PROPERTIES

(75) Inventors: Philippe Lecour, Les Mureaux (FR); Xavier Longaygue, Noisy le Roi (FR); François Ropital, Rueil Malmaison (FR); Laurent Antoni, Pontcharra (FR)

(73) Assignees: Institute Francais du Petrole, Rueil Malmaison Cedex (FR); USINOR, La Defense Cedex (FR)

( * ) Notice: Subject to any disclaimer, the term of this patent is extended or adjusted under 35 U.S.C. 154(b) by 373 days.

(21) Appl. No.: 10/045,092

(22) Filed: Jan. 15, 2002

(65) Prior Publication Data

US 2002/0129876 A1 Sep. 19, 2002

(30) Foreign Application Priority Data

Jan. 15, 2001 (FR) ..... 01 00469

(51) Int. Cl.[7] ..... C10G 75/00

(52) U.S. Cl. ..... 208/48 R; 585/920; 585/950; 585/654; 420/34; 420/56; 420/57; 420/58; 420/59; 420/60; 420/61; 420/67; 420/68; 420/73; 420/74; 420/75; 420/91; 420/92; 420/93; 420/119; 420/120; 208/134; 208/113; 208/132

(58) Field of Search ..... 208/48 R; 585/920, 585/950; 420/34, 56, 57, 58, 59, 60, 61, 67, 68, 73, 74, 75, 91, 92, 93, 119, 120

(56) References Cited

U.S. PATENT DOCUMENTS 3,152,934 A * 10/1964 Remus ..... 148/578
3,736,131 A * 5/1973 Espy ..... 420/34
3,756,807 A 9/1973 Hoshino
5,693,155 A 12/1997 Mousseaux et al.
6,056,917 A * 5/2000 Chesseret et al. ..... 420/60
6,235,238 B1 * 5/2001 Lecour et al. ..... 420/67
6,444,168 B1 * 9/2002 Lecour et al. ..... 420/67
6,682,582 B1 * 1/2004 Speidel ..... 75/252

FOREIGN PATENT DOCUMENTS

| | | |
|---|---|---|
| DE | 506905 | 6/1939 |
| EP | 0 750 053 | 12/1996 |
| EP | 0 949 347 | 10/1999 |
| FR | 2 071 667 | 9/1971 |
| FR | 2 766 843 | 2/1999 |

* cited by examiner

*Primary Examiner*—Walter D. Griffin
(74) *Attorney, Agent, or Firm*—Millen, White, Zelano & Branigan, P.C.

(57) ABSTRACT

An austenitic stainless steel with a composition comprising:

at most 0.15% of C;
2% to 10% of Mn;
at most 2% of Ni;
at most 4% of Cu;
0.1% to 0.4% of N;
10% to 20% of Cr;
at most 1% of Si;
at most 3% of Mo; and
at most 0.7% of Ti;

is used to manufacture equipment, for example furnaces, reactors or ducts, or elements of this equipment, or to coat the internal walls of this equipment, said equipment being used to implement petrochemical processes conducted at temperatures of 350° C. to 1100° C. and in which coke can be formed.

22 Claims, 2 Drawing Sheets

USE OF AUSTENITIC STAINLESS STEELS IN APPLICATIONS REQUIRING ANTI-COKING PROPERTIES

BACKGROUND OF THE INVENTION

1. Field of the Invention

The present invention relates to the use of austenitic stainless steels in applications requiring anti-coking properties.

In accordance with the invention, these steels are used to manufacture equipment, for example furnaces, reactors or ducts, or elements for producing such equipment, or to coat the internal walls of furnaces, reactors or ducts, this equipment being used in particular to implement petrochemical processes carried out at temperatures of 350° C. to 1100° C. and during which coke can be formed.

The invention also relates to reactors, furnaces, ducts or their elements produced from or coated with these steels.

The carbonaceous deposit that can develop in furnaces during hydrocarbon conversion is usually known as coke. This coke deposit is a nuisance in industrial units. The formation of coke on the walls of tubes and reactors causes a reduction in heat exchange, major blockages and thus, an increase in pressure drops. To keep the reaction temperature constant, the temperature of the walls may have to be increased, risking damage to the constituent alloy of the walls. A reduction in unit selectivity is also observed, resulting in a reduction in yield.

2. Description of the Prior Art

Japanese application JP-A-03-104 843 describes refractory anti-coking steel for an ethylene cracking furnace tube. However, that steel contains more than 15% of chromium and nickel. It was developed to limit coke formation between 750° C. and 900° C. for ethylene cracking.

U.S. Pat. No. 5,693,155 relates to petrochemical processes using stainless steels rendered less coking by adding up to 5% of silicon. Such steels contain at least 10% of nickel, which makes them expensive.

Further, French patent application FR-A-2 766 843 describes an austenitic stainless steel with a low nickel content, which is cheaper compared with the standard grade (AISI 304), but which has equivalent mechanical and welding properties.

That steel has the following composition:

0.1% to 1% of silicon;

5% to 9% of manganese;

0.1% to 2% of nickel;

13% to 19% of chromium;

1% to 4% of copper;

0. 1% to 0.40% of nitrogen;

$5\times10^{-4}$% to $50\times10^{-4}$% of boron;

at most 0.05% of phosphorus; and at most 0.01% of sulphur.

SUMMARY OF THE INVENTION

We have now discovered that steels of the above type have good anti-coking properties and can advantageously be used for the manufacture of equipment, for example furnaces, reactors or ducts, or elements of equipment, for example tubes, plates, sheets, screens, profiles or rings, or to coat the internal walls of furnaces, reactors or ducts, said equipment being intended to implement petrochemical processes carried out at temperatures of 350° C. to 1100° C. and in which coke can be formed.

The present invention concerns the use of stainless steels with a composition specific for the production of good coking resistance, but which retain an austenitic structure despite a reduced nickel content. The high temperature behaviour of stainless steels with an austenitic structure combines good corrosion resistance with good mechanical behaviour, including weldability.

DETAILED DESCRIPTION OF THE INVENTION

Figure 1:
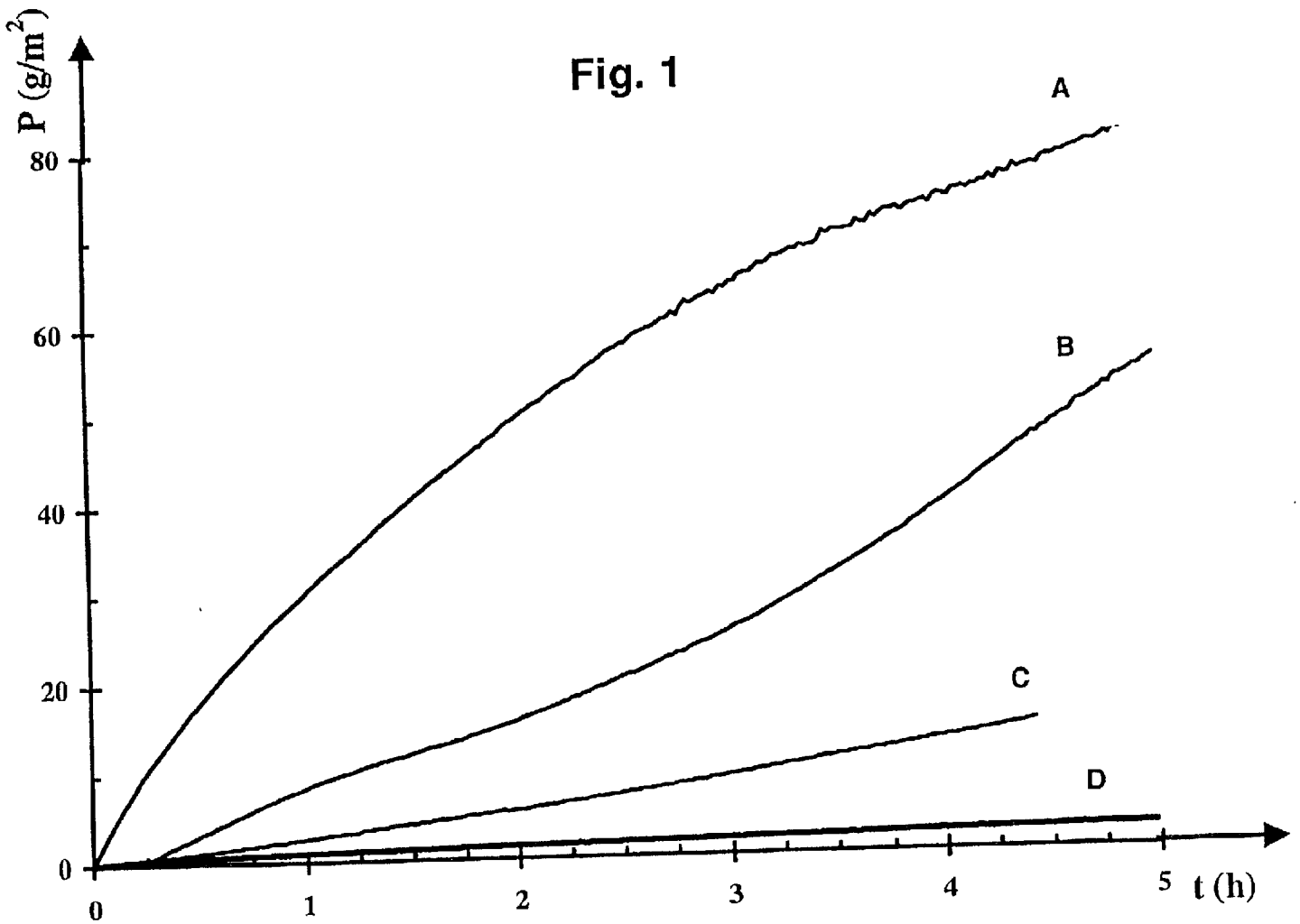
FIG. 1 shows coking weight gain curves for different steels during an isobutane dehydrogenation reaction.

The steels used in the invention can generally be characterized in that they contain austenitic stainless steel with a composition comprising:

at most 0.15%, preferably at most 0.1%, of C;

0.2% to 10%, preferably 5% to 10%, of Mn;

at most 2% of Ni;

at most 4% of Cu;

0.1% to 0.4% of N;

10% to 20%, preferably 15% to 18%, of Cr;

at most 1% of Si;

at most 3% of Mo; and at most 0.7% of Ti

In the present description, all the contents are expressed as the % by weight.

For such steels to retain their austenitic structure, the reduction in nickel content compared with standard grades such as AISI 304, 316 or 321 steels must essentially be compensated by increasing the manganese and nitrogen content and introducing copper, as like nickel, these elements are gamma-forming elements. The region corresponding to the austenitic structure is shown on the Schaeffler diagram as a function of the nickel and chromium equivalent values. Such a diagram can, for example, be found in "Les Aciers Inoxydables" [Stainless Steels] by P. Lacombe, B. Baroux, G. Béranger, Les Editions de Physique, Chapter 16, pages 572 & 573.

Preferably, the steels used in the invention also contain:

at most 0.01%, preferably at most 0.030% of S;

at most 0.05%, preferably at most 0.045% of P; and at most 0.005% of B.

When they contain boron, these steels can contain 0.0005% to 0.005%, for example.

They can also contain:

at most 1.1% of Nb;

at most 0.40% of V;

at most 0.05% of Al; and at most 0.002% of Ca.

In a first variation of the invention, steel with the following composition can be used:

about 0.05% of C;

about 7.5% of Mn;

about 1.5% of Ni;

about 2.5% of Cu;

about 0.15% of N;

about 18% of Cr; and about 0.5% of Si.

In a further variation of the invention, steel with the following composition can be used:

about 0.04% of C;

about 10% of Mn;

about 1.5% of Ni;

about 4% of Cu;

about 0.1% of N;

about 17% of Cr;

about 0.5% of Si; and about 0.7% of Ti.

In a still further variation of the invention, steel with the following composition can be used:

about 0.05% of C;

about 8.5% of Mn;

about 1.5% of Ni;

about 3% of Cu;

about 0.2% of N;

about 17% of Cr;

about 0.5% of Si; and about 2.1% of Mo.

These three composition variations retain the austenitic structure of the stainless steel, according to the Schaeffler diagram ($Ni_{eq}$—$Cr_{eq}$).

The steels used in the present invention can be produced using conventional smelting and casting methods, then can be formed by the usual techniques for producing elements such as tubes, plates, sheets, screens, profiles, rings, etc. In this case, the elements or semi-finished products are formed all of a piece. They can be used to construct the principal parts of equipment such as furnaces, reactors or ducts, or only the accessory or auxiliary parts of this equipment.

In accordance with the invention, the steels can also be used in the form of powders to form coatings on the internal walls of furnaces, reactors or ducts. The coating is, for example, produced using at least one technique selected from co-centrifuging, plasma, PVD (physical vapour deposition), CVD (chemical vapour deposition), electrolytic deposition, overlay and plating.

Facilities comprising the equipment produced from such inventive steels are intended for use in implementing petrochemical processes carried out at temperatures in the range 350° C. to 1100° C., and in which coke may form. These processes include catalytic cracking or thermal cracking, catalytic reforming and saturated hydrocarbon dehydrogenation, for example.

As an example, during catalytic reforming, which produces a reformate between 450° C. and 650° C., a secondary reaction results in coke formation. This is also the case during isobutane dehydrogenation, which can produce isobutene between 550° C. and 700° C.

Figure 2:
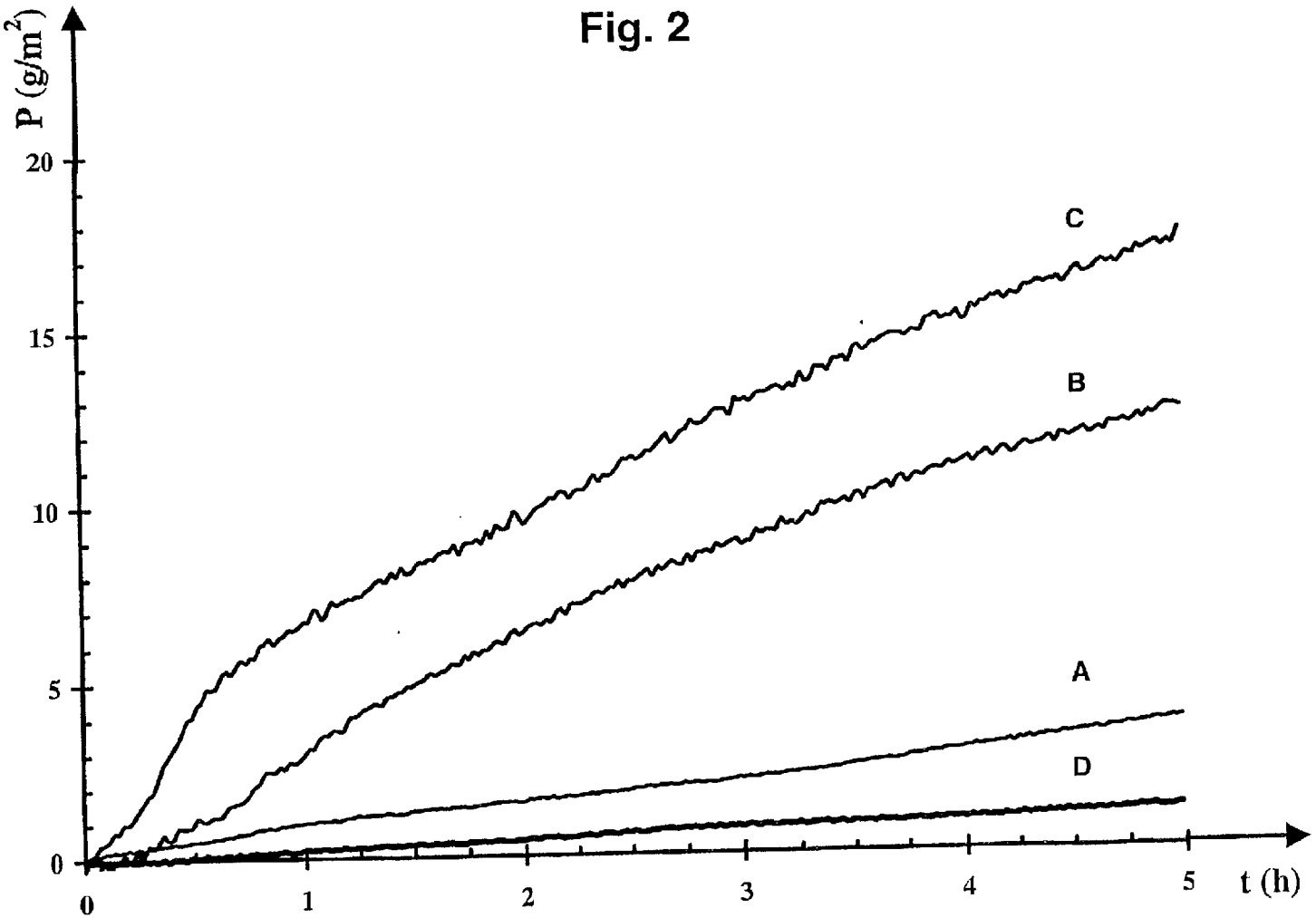
FIG. 2 shows coking weight gain curves for different steels during a catalytic reforming reaction.

The invention will be better understood and its advantages will become more clear from the following non-limiting examples and tests and the accompanying FIGS. 1 and 2 in which:

FIG. 1 shows coking weight gain curves for different steels during an isobutane dehydrogenation reaction;

FIG. 2 shows coking weight gain curves for different steels during a catalytic reforming reaction.

EXAMPLES

The steels used were:

three standard austenitic stainless steels with a high nickel content routinely used for the production of reactors or reactor elements (steels A, B, C), tested for comparison purposes;

and, in accordance with the invention, an austenitic stainless steel with a reduced nickel content (steel D).

Table 1 below shows the composition of these steels, and the value of $Ni_{eq}$ and $Cr_{eq}$ for each steel, calculated using the formulae:

$$Ni_{eq}=\%\ Ni+\%\ Co+0.5(\%\ Mn)+30(\%\ C)+0.3\ (\%\ Cu)+25(\%\ N);$$

$$Cr_{eq}=\%\ Cr+2.0(\%\ Si)+1.5(\%\ Mo)+5.5(\%\ Al)+1.75(\%\ Nb)+1.5(\%\ Ti)+0.75(\%\ W)$$

TABLE 1

Steel compositions

| Steel | C | Mn | Ni | Cu | N | $Ni_{eq}$ | Cr | Si | Mo | Ti | $Cr_{eq}$ |
|---|---|---|---|---|---|---|---|---|---|---|---|
| A | 0.04 | 1.5 | 8.7 | — | 0.045 | 11.8 | 18.0 | 0.5 | — | — | 19.8 |
| B | 0.03 | 1.3 | 9.2 | — | 0.045 | 11.9 | 17.5 | 0.5 | — | 0.3 | 19.7 |
| C | 0.05 | 1.5 | 10.6 | — | 0.045 | 14.0 | 17.0 | 0.5 | 2.1 | — | 21.9 |
| D | 0.03 | 7.5 | 1.6 | 2.8 | 0.2 | 12.1 | 16.7 | 0.8 | — | — | 19.1 |

Further, steels A, B and C contained at most 0.3% of sulphur and at most 0.045% of phosphorus. Steel D contained at most 0.01% of sulphur and at most 0.05% of phosphorus.

As can be seen, steel D's composition produced values for $Ni_{eq}$ l and $Cr_{eq}$ that were very close to those of austenitic steels A, B and C.

Example 1

The different steels of Table 1 were tested in an isobutane dehydrogenation reactor.

The following operating protocol was used to carry out the test:

the steel samples were cut by electro-erosion then polished with SiC#180 paper to produce a standard surface state and remove the film of oxide that may have formed during cutting;

degreasing was carried out in a bath of $CCl_4$, acetone then ethanol;

the samples were suspended on the arms of a thermobalance;

the tube reactor was closed and the temperature was raised in argon; and the reaction mixture was injected into the reactor.

The microbalance allowed the weight gain of the sample per unit time and per unit surface area of the sample to be measured continuously.

The different steels of Table 1 were tested in a dehydrogenation reaction carried out at a temperature of about 650° C. and with a hydrogen/isobutane mole ratio of 50/50, in the presence of 10% of argon.

FIG. 1 shows graphs of the variation in weight gain on coking (P, $g/m^2$) as a function of time (t, in hours) for the different steels A, B, C and D. This figure shows that coking of steel D, with a low nickel content, was substantially less than that of standard steels A, B and C.

Example 2

The different steels shown in Table 1 were tested in a catalytic naphtha reforming reactor. The protocol for preparing the steel samples was the same as that described above and the test protocol was the same as that described for Example 1.

The catalytic reforming reaction was carried out at 650° C. with a hydrogen/hydrocarbon mole ratio of 6/1. A secondary reaction was coke formation. At the temperatures used in the process, coke deposition was principally constituted by coke of catalytic origin.

FIG. 2 shows graphs of the variation in weight gain on coking (P, $g/m^2$) as a function of time (t, in hours) for the different steels A, B, C and D. This figure shows that coking of steel D, with a low nickel content, was substantially less than that of standard steels A, B and C.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosures of all applications, patents and publications cited above and below, and of corresponding French application 01/00469, filed Jan. 15, 2001 are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process of diminishing coking in a petrochemical process conducted in contact with a surface subjected to coking, comprising providing said surface, at least in part with an austenitic steel comprising:

iron;

at most 0.15 wt % of C;

2 wt % to 10 wt % of Mn;

at most 2 wt % of Ni;

at most 4 wt % of Cu;

0.1 wt % to 0.4 wt % of N;

10 wt % to 20 wt % of Cr;

at most 1 wt % of Si;

at most 3 wt % of Mo; and at most 0.7 wt % of Ti.

2. A process according to claim 1, wherein said steel comprises:

at most 0.1 wt % of C;

5 wt % to 10 wt % of Mn; and 15 wt % to 18 wt % of Cr.

3. A process according to claim 1, wherein said steel comprises:

about 0.05 wt % of C;

about 7.5 wt % of Mn;

about 1.5 wt % of Ni;

about 2.5 wt % of Cu;

about 0.15 wt % of N;

about 18 wt % of Cr; and about 0.5 wt % of Si.

4. A process according to claim 1 wherein said steel comprises:

about 0.04 wt % of C;

about 10 wt % of Mn;

about 1.5 wt % of Ni;

about 4 wt % of Cu;

about 0.1 wt % of N;

about 17 wt % of Cr;

about 0.5 wt % of Si; and about 0.7 wt % of Ti.

5. A process according to claim 1, wherein said steel comprises:

about 0.05 wt % of C;

about 8.5 wt % of Mn;

about 1.5 wt % of Ni;

about 3 wt % of Cu;

about 0.2 wt % of N;

about 17 wt % of Cr;

about 0.5 wt % of Si; and about 2.1 wt % of Mo.

6. A process according to claim 1, wherein said steel comprises:

at most 0.01 wt % of S;

at most 0.05 wt % of P; and at most 0.005 wt % of B.

7. A process according to claim 6, wherein said steel comprises 0.0005 wt % to 0.005 wt % of B.

8. A process according to claim 6, wherein said steel further comprises:

at most 1.1 wt % of Nb;

at most 0.40 wt % of V;

at most 0.05 wt % of Al; and at most 0.002 wt % of Ca.

9. A process according to claim 1, wherein said steel comprises:

at most 0.030 wt % of S; and at most 0.045 wt % of P.

10. A process according to claim 9, wherein said steel further comprises:

at most 1.1 wt % of Nb;

at most 0.40 wt % of V;

at most 0.05 wt % of Al; and at most 0.002 wt % of Ca.

11. A process according to claim 1, wherein said steel further comprises:

at most 1.1 wt % of Nb;

at most 0.40 wt % of V;

at most 0.05 wt % of Al; and at most 0.002 wt % of Ca.

12. A process according to claim 1, wherein said petrochemical process is carried out at temperatures of 350° C. to 1100° C.

13. A process according to claim 12, wherein said petrochemical process is a catalytic reforming process that produces a reformate at temperatures of 450° C. to 650° C.

14. A process according to claim 12, wherein said petrochemical process is isobutane dehydrogenation to produce isobutene at temperatures of 550° C. to 700° C.

15. A process according to claim 1, wherein said steel comprises at most 0.1 wt % of C.

16. A process according to claim 1, wherein said steel comprises 5 wt % to 10 wt % of Mn.

17. A process according to claim 1, wherein said steel comprises 15 wt % to 18 wt % of Cr.

18. A process according to claim 1, wherein said petrochemical process is catalytic cracking.

19. A process according to claim 1, wherein said petrochemical process is thermal cracking.

20. A process according to claim 1, wherein said petrochemical process is catalytic reforming.

21. A process according to claim 1, wherein said petrochemical process is saturated hydrocarbon dehydrogenation.

22. A process of diminishing coking in a petrochemical process conducted in contact with a surface subjected to coking, comprising coating said surface with an austenitic steel comprising:

iron;

at most 0.15 wt % of C;

2 wt % to 10 wt % of Mn;

at most 2 wt % of Ni;

at most 4 wt % of Cu;

0.1 wt % to 0.4 wt % of N;

10 wt % to 20 wt % of Cr;

at most 1 wt % of Si;

at most 3 wt % of Mo; and at most 0.7 wt % of Ti.

* * * * *